United States Patent [19]

Narberes

[11] Patent Number: 4,942,277

[45] Date of Patent: Jul. 17, 1990

[54] MICROWAVE POPCORN SERVICE BOWL

[76] Inventor: Gary A. Narberes, 976 Jonell La., Chico, Calif. 95926

[21] Appl. No.: 451,445

[22] Filed: Dec. 15, 1989

[51] Int. Cl.[5] ..... H05B 6/80; A23L 1/18

[52] U.S. Cl. ..... 219/10.55 E; 99/323.5; 99/323.8; 99/DIG. 14

[58] Field of Search ..... 219/10.55 E, 10.55 F, 219/10.55 R; 99/323.5, 323.8, DIG. 14, 451; 426/243, 241

[56] References Cited

U.S. PATENT DOCUMENTS

| | | | |
|---|---|---|---|
| 3,722,399 | 3/1973 | Cole | 99/323.8 |
| 4,477,705 | 10/1984 | Danley et al. | 219/10.55 E |
| 4,496,816 | 1/1985 | McNamara | 219/10.55 E |
| 4,532,397 | 7/1985 | McClelland | 219/10.55 E |
| 4,563,561 | 1/1986 | Vaeth et al. | 219/10.55 E |
| 4,823,683 | 4/1989 | Meisner | 99/323.5 |
| 4,873,406 | 10/1989 | Connor | 219/10.55 E |

*Primary Examiner*—Philip H. Leung

[57] ABSTRACT

In this invention, a popcorn service bowl fabricated of microwave penetrable materials is arranged with an opened top end covered by a snap-on removable cover and a bottom end terminating in a compartment inherent to the bowl. The compartment is accessible from the bowl through multiple apertures in the bottom of the bowl and has an opening opposite the apertured bowl bottom which is covered by a removable snap-on cover. This cover and compartment arrangement adapts the bowl to be inverted and useful for popping popcorn in a microwave oven and for serving the popcorn popped with the bowl upright and the top end cover removed. The compartment is useful as a receptacle for containment and disposal of unpopped kernels of popcorn and as a resting base for the bowl. With the bowl inverted, the compartment is also useful for melting and distributing a buttering substance over the popped popcorn.

6 Claims, 5 Drawing Sheets

MICROWAVE POPCORN SERVICE BOWL

BACKGROUND OF THE INVENTION

1. Field of the Invention:

This invention relates to popcorn service bowls having special features for popping popcorn and for removing unpopped kernels. The present invention is particularly directed towards a popcorn service bowl which can be inverted for popping popcorn in a microwave oven and afterwards turned upright as a serving bowl. An apertured compartment is structed into the bowl for loading popcorn to be popped, buttering popcorn during popping, and removing unpopped kernels by having them drop into the compartment.

2. Description of the Prior Art:

To ascertain the development and present stage of past art, a patent search was conducted the U.S. Patent and Trademark Office in the classes and subclasses of 99/33.5, 323.8, 323.11, and D7/325. An older patent issued to McClarrinon on Sept. 19, 1916, U.S. Pat. No. 1,198,938, relates to a popper with means to separate popped and unpopped kernals. This device is a metal box useful for popping popcorn primarily over an open fire. A sliding panel can be pulled, opening holes in the popping compartment flooring allowing unpopped kernels to drop into a bottom section. The device is structured of sheet metal.

Typical of more modern devices is the Kiczek popcorn popper. In U.S. Pat. No. 4,445,427, dated May 1, 1984, Kiczek discloses a familiar style of corn popper having a cooker bottom and a bowl top. After popping the top can be used as a server. A funnel section in the center of the cooker bottom is provided for popping and buttering the popcorn. A pointed cone positioned center in the bowl top points down into the cooker funnel section to deflect the popping corn causing it to "jump" into a gap between the cooker wall and the popper funnel. Similar usage of pointed cone shapes is seen in several of the later issued patents.

Typical of bowl-type poppers useful in microware ovens is the Meisner popcorn popper. His patent is dated Apr. 25, 1989, and is U.S. Pat. No. 4,823,683. His popcorn popper is bowl-like with a removable cover on top. His device is manufactured of materials penetrable by microwaves. For a unique feature, Meisner has an arrangement of three radiating recesses in the bottom of his bowl for receiving a measured amount of the popcorn to be popped.

Other microwave popcorn popper disclosures appeared to be variations of the foregoing and did not appear pertinent to the simple and unique device of the immediate invention hereinafter disclosed.

SUMMARY OF THE INVENTION

Therefore, in practicing my invention, I have provided a bowl manufactured of materials pentrable by microwaves having a removable cover on the top and a removable cover over a bottom opening with a compartment formed into the bottom of the bowl. Unique to this invention is that the bowl is turned upside down for popping popcorn in a microwave oven and turned upright for serving the popped popcorn. With the bopwl inverted, the bottom receptacle is useful for loading popcorn to be popped into the bowl, for buttering the popcorn during and after popping, and with the bowl upright, for separating unpopped kernels and partly popped kernel from the popped popcorn. To provide this usage, the rounded bottom end inside the popcorn service bowl over the compartment is multi-apertured in a size which allows uncooked and poorly cooked kernels of popcorn to pass through. These same apertures provide the passageway, when the bowl is inverted, for loading the new popcorn into the bowl and for dipping melted butter onto the popcorn from the compartment.

Therefore, it is a primary object of the invention to provide a popcorn service bowl useful inverted for popping popcorn in a microwave oven and useful upright as a serving bowl for the popped popcorn.

Another object of the present invention is to provide a popcorn popping bowl for microware use which has a containment compartment in the bowl allowing separation of unpopped kernels and poorly kernels from the finished popcorn by simply shaking the bowl.

A further object of this invention is to provide a popcorn service bowl with a compartment having multiple aperture acces to the main bowl useful with the bowl inverted for loading popcorn to be popped into the bowl and distributing melted butter over popcorn being popped or after the popcorn is popped.

A still further object of the invention is to provide a popcorn service bowl useful for microwave popping of popcorn having a snap-on removable top cover and a snap-on removable cover over a bottom compartment with the top cover removable for serving popcorn from the bowl and the bottom cover removable to recover unpopped kernels and poorly popped kernels from the compartment.

Other objects particular to this invention and the many advantages provided by the simplicity of the device will become obvious by reading descriptions of numbered parts in the specification and subsequent comparison of these parts as illustrated and similarly numbered in the accompanying drawings.

DESCRIPTON OF THE PREFERRED EMBODIMENTS

Figure 1:
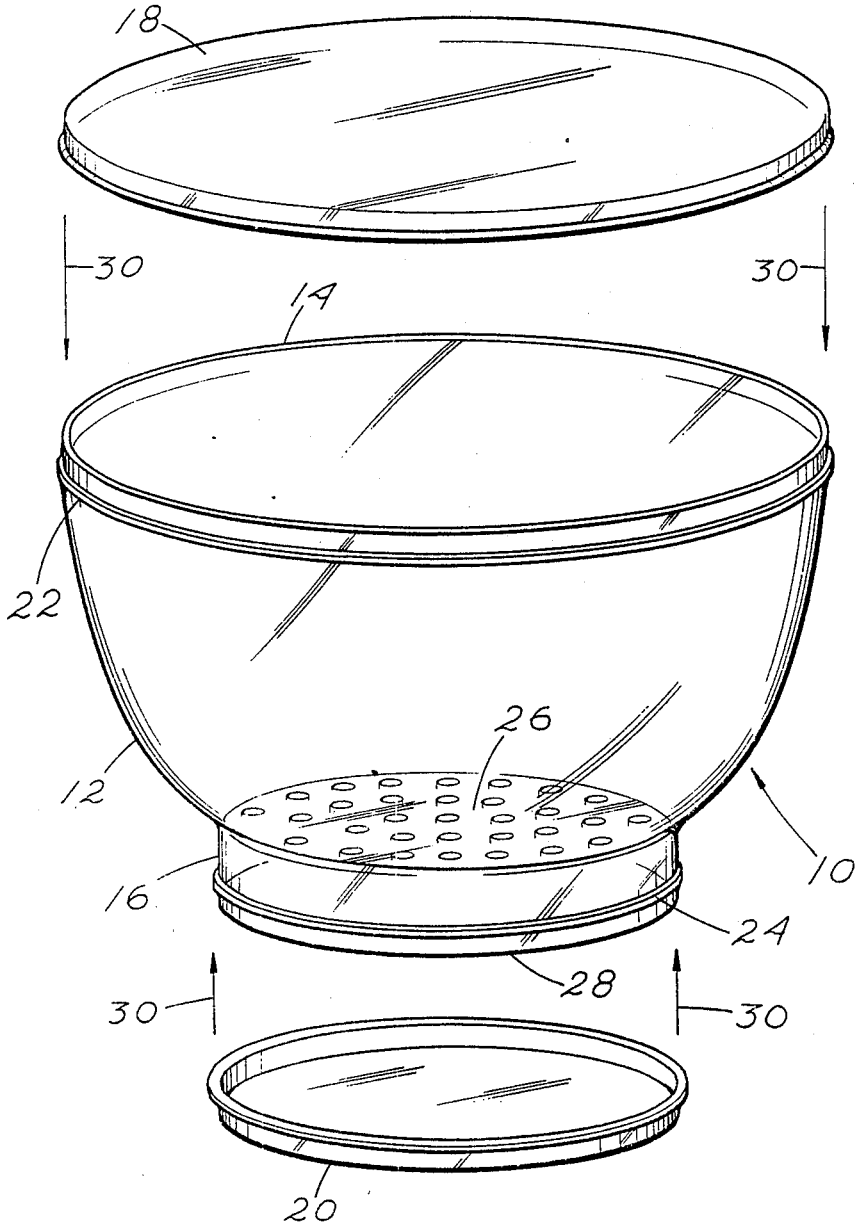
FIG. 1 is a perspective view of a popcorn service bowl according to the invention with the top snap-on cover removed and positioned above the top of the service bowl and the bottom snap-on cover removed and positioned below the unpopped kernel compartment. The multi-apertured base inside the bowl over the unpopped kernel compartment can be seen through the transparent wall of the bowl.

Referring now to the drawings where the numeral 10 generally indicates a popcorn service bowl according to the invention structured of microwave penetrable materials. FIG. 1 shows popcorn service bowl 10 upright with attachments separated to illustrate the simplicity of the bowl and the components. In FIG. 1, bowl 12, the bowl part of the invention, is shown with the open bowl top 14 upwards and snap-on bowl cover 18 positioned above bowl 12 ready for installation. Snap-on bowl cover 18 is a removable pliable cover which seats against bowl cover seat 22 tightly enough to maintain the attachment during popcorn popping but can be easily removed for access into bowl 12. A multi apertured bowl bottom 26 can be seen in the drawing through the transparent wall of bowl 12. Apertured bowl bottom 26 covers the top of buttering and kernel receiver compartment 16 which is a collar-like base inherent to bowl 12 at the apex of the curved bottom of bowl 12. Buttering and kernel receiver compartment 16 has an open bottom, open compartment bottom 28, which can be closed by snap-on compartment cover 20 shown below open compartment bottom 28 in the FIG. 1 illustration. Snap-on compartment cover 20 is structured of the same pliable material as is snap-on bowl cover 18 and fits snugly over the lip of open compartment bottom 28 abutted against compartment cover seat 24. Directional indicators 30, which indicate attachement directions, show the direction of attachments of the two covers 18 and 20 in FIG. 1.

Figure 2:
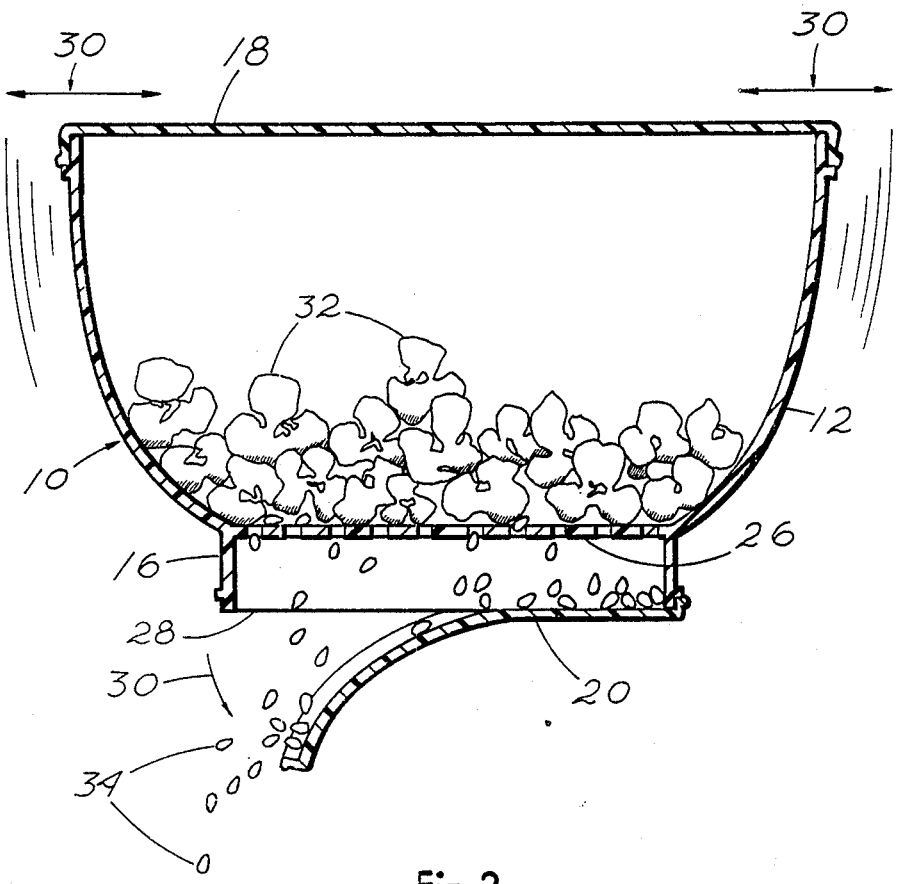
FIG. 2 is a sectional side view of the service bowl showing the top cover snapped onto the top of the bowl and the bowl being shaken to remove unpopped kernels through the multi-apertured base of the bowl into the unpopped kernel compartment. Also illustrated is the opening of the compartment covering allowing unpopped kernels to be removed from the compartment.

FIG. 2, in a sectional side view of popcorn service bowl 10, shows snap-on bowl cover 18 snapped to the top of bowl 12 and bowl 12 being shaken, see shake lines and directional indicators 30, to separate popped popcorn 32 from unpopped kernals 34 and to cause unpopped kernels 34 to fall through the apertures in apertured bowl bottom 26 into the unpopped kernel compartment, buttering and kernel receiver compartment 16. Buttering and kernel receiver compartment 16 is shown in the FIG. 2 illustration with snap-on compartment cover partly opened allowing unpopped kernels 34 to be removed from the compartment.

Figure 3:
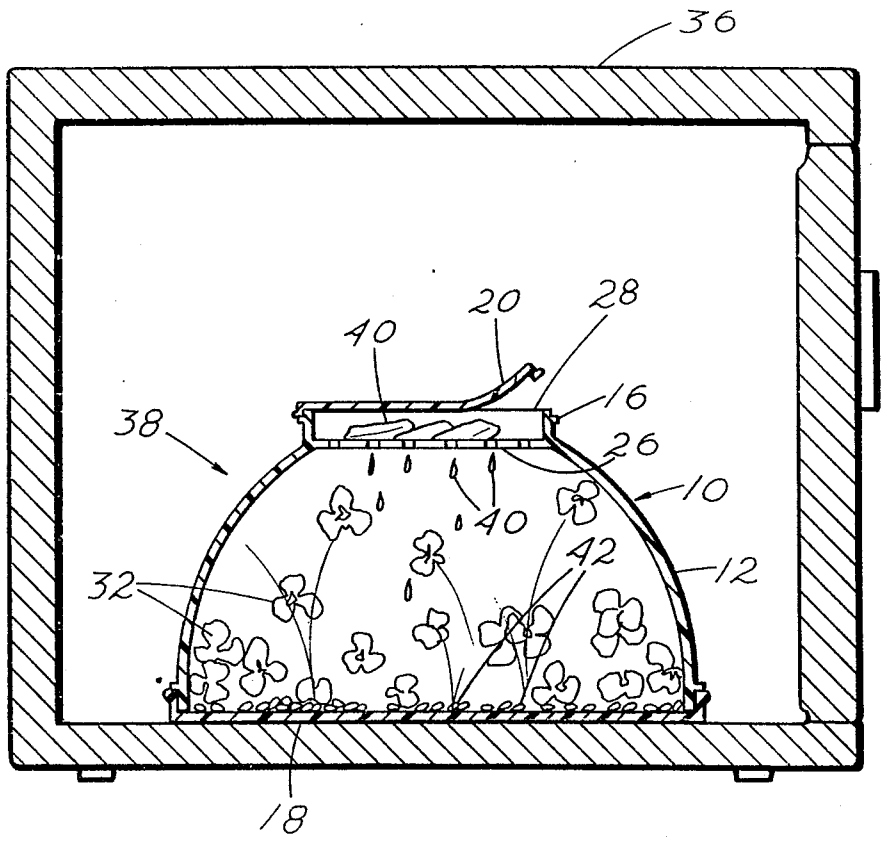
FIG. 3 illustrates the service bowl according to the invention having the bowl cover attached with the bowl inverted and popping in a microwave oven. The unpopped kernel compartment is shown upwards being used for melting and distributing a butter product on the popping corn. Although the unpopped kernel compartment cover could be removed, it is shown in the illustration partly opened to provide moisture and air release.

In FIG. 3, popcorn service bowl 10 according to the invention, is shown inverted 38 for popping popcorn kernels to be popped 42 in microware oven 36. Bowl 12 is positioned with attached snap-on bowl cover 18 downward. Buttering and kernel receiving compartment 16 is upward and snap-on compartment cover 20 is partly opened to relieve cooking pressure from inside bowl 12. Buttering and kernel receiving compartment 16 is shown being used to melt butter product 40 and to distribute the meltage through apertured bowl bottom 26 onto popped popcorn 32. Snap-on compartment cover 20 could be removed entirely during popcorn popping. Although not shown, buttering and kernel receiving compartment 16 could also be used for loading popcorn to be popped 42 into bowl 12 through apertured bowl bottom 26 instead of through open bowl top 14 as is normally done.

Figure 4:
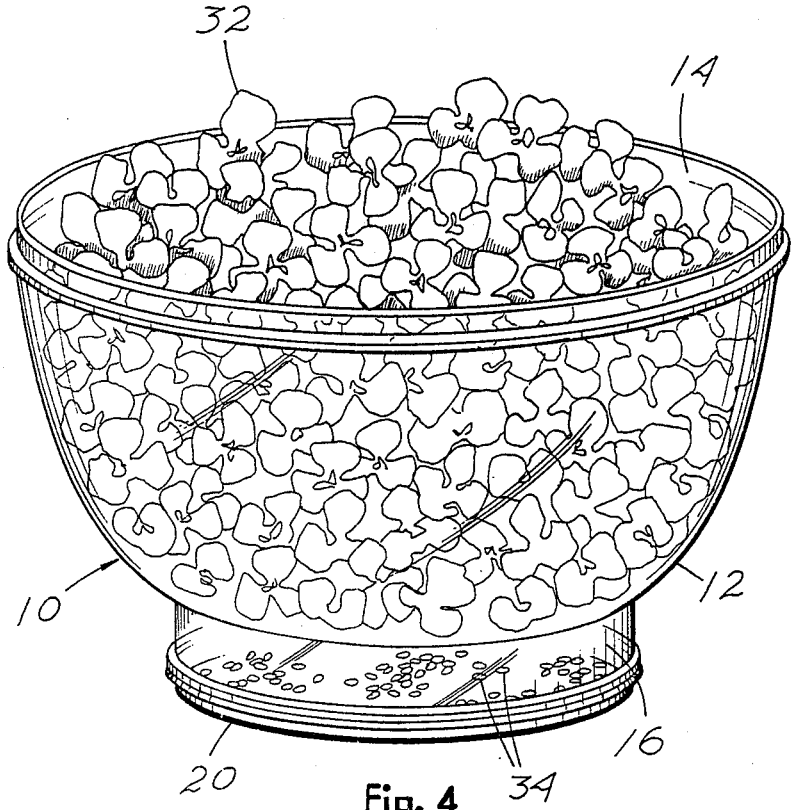
FIG. 4 is a perspective view of the service bowl being used for serving popped popcorn. The cover is on the unpopped kernel receiving compartment which is downward in the illustration and the compartment acts as a support base for the popcorn service bowl.

FIG. 4 shows popcorn service bowl 10 upright in a perspective view with snap-on bowl cover 18 removed and bowl 12 being used for serving popped popcorn 32. Buttering and kernel receiving compartment 16 with snap-on compartment cover 20 attached is used as a base for bowl 12.

Figure 5:
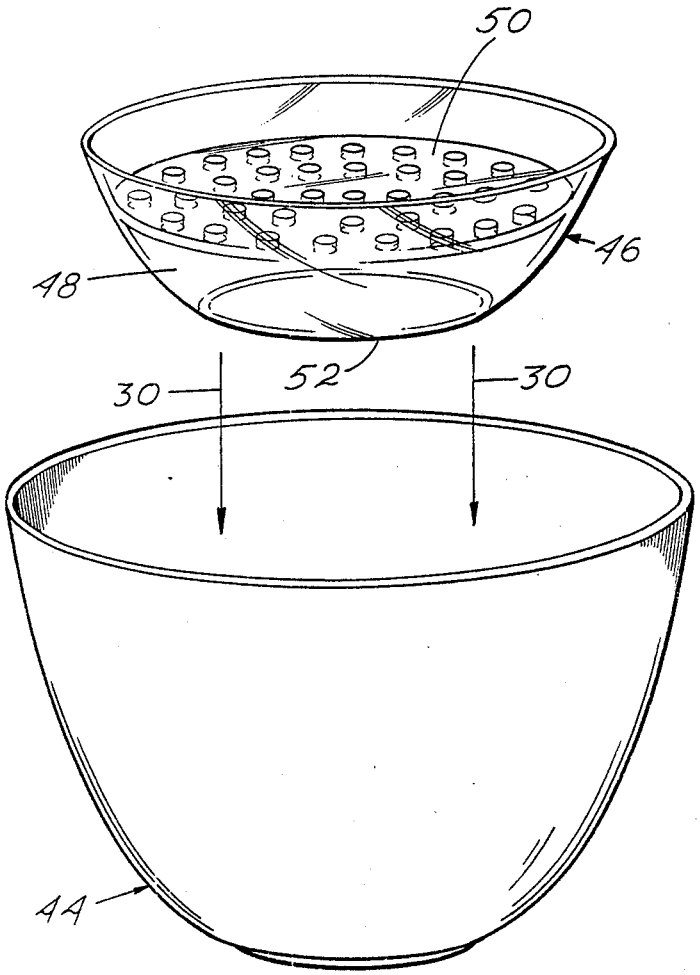
FIG. 5 is a perspective view of an ordinary bowl useful for serving popcorn and an independent embodiment of the unpopped kernel compartment shaped to be useful in the bottom of any round service bowl.

FIG. 5 is a perspective view illustrating how a special body segment of the invention, auxiliary kernel receiving bowl section 46, could be used with most any concave shaped standard bowl 44 for separating unpopped kernels in a serving bowl after the popcorn has been popped. As illustrated, auxiliary kernel receiving bowl section 46 would be place in the bottom of standard bowl 44 with the curved sides of auxiliary bowl section kernel receiving compartment 48 against the curved sides of standard bowl 44. The open bottom 52 of auxiliary bowl section kernel receiving compartment 48 would be towards the bottom of standard bowl 44 allowing unpopped kernels of popcorn to pass through auxiliary bowl apertured panel 50 and be separated from the popcorn. These unpopped kernels of popcorn would pass through open bottom 52 of auxiliary bowl section kernel receiving compartment 48 and remain in the bottom of standard bowl 44 until emptied.

To use popcorn service bowl 10 as illustrated in FIG. 3 and FIG. 4, popcorn kernels to be popped 42 can be placed in bowl 12 before inversion or can passed through apertured bowl bottom 26 in buttering and kernel receiver compartment 16 with both 12 inverted, which is the way popcorn service bowl 10 of this invention is used. With popcorn kernels to be popped 42 on the inside surface of snap-on bowl cover 18, popcorn service bowl 10 is placed inside of the microwave oven 36 and popcorn kernels to be popped 42 are popped. Directions for popping are usually supplied with the popcorn package, with microwave oven 36 generally set on high for three to four minutes or until popping slows down and a visual survey shows bowl 12 to be full. Buttering and kernel receiving compartment 16 can be used as illustrated in FIG. 3 for melting and distributing butter or butter product 40 over popped popcorn 32. After removing popcorn service bowl 10 from microwave oven 36 and re-attaching snap-on compartment cover 20, bowl 12 can be turned open bowl top 14 up and with snap-on bowl cover 18 removed bowl 12 can be used as a serving bowl. See FIG. 4. As a serving bowl, snap-on compartment cover 20 is left in place and buttering and kernel receiver compartment 16 becomes a support base for bowl 12 with snap-on compartment cover 20 preventing any of butter product 40 or unpopped kernels 34 from escaping to soil a serving table surface. If removal of unpopped kernals 34 prior to buttering or serving is desired, snap-on compartment cover 20 can be opened, FIG. 2, or taken off and unpopped kernels 34 can be removed through open compartment bottom 28. For buttering after popped popcorn 32 is finished and unpopped kernels 34 have been removed, bowl 12 can again be turned upside down and placed back inside microwave oven 36 with butter or a butter product 40 in buttering and kernel receiver compartment 16 long enough to melt product 40 as illustrated in FIG. 3.

As popcorn service bowl 10, the device of this invention, has been illustrated in the drawings and described in the specification extensively, it is to be understood that the drawings and specification are for illustrative and description purposes only and not intended to limit the invention to a particular configuration so long as other versions of the invention remain subject to the indended scope of the claims.

What I claim as my invention is:

1. A popcorn service bowl fabricated of materials penetrable by microwaves in an arrangement providing said bowl with an opened top end covered by a snap-on removable cover and a bottom end terminating in a compartment, said compartment being accessible from said bowl through multiple apertures in the bottom of said bowl, said compartment having an opening opposite said bowl apertured bottom with said opening covered by a removable snap-on cover, said arrangement adapting said popcorn service bowl to be inverted and used for popping said popcorn in a microwave oven with said compartment removable snap-on cover opend providing a cooking pressure releasing means and said arrangement further adapting said bowl for serving said popcorn popped with said bowl upright and said top end snap-on removable cover removed, said compartment being a receptacle for containment and disposal of unpopped and partly popped kernels of said popcorn and with bowl inverted, said compartment being useful for loading uncooked popcorn into said bowl and for melting and distributing a buttering substance over said popped popcorn through said bowl bottom apertures.

2. The popcorn service bowl of claim 1 wherein said microwave penetrable materials being a pliable plastic.

3. The popcorn service bowl of claim 1 wherein said microwave penetrable materials being visibly transparent.

4. The popcorn service bowl of claim 1 wherein said multiple bottom apertures of said bowl are sized to pass said uncooked popcorn , said unpopped popcorn kernels, and small sizes of kernals of said party popped popcorn.

5. The popcorn service bowl of claim 1 wherein said compartment further adapts said popcorn service bowl for removal of said unpopped popcorn kernels and said partly popped popcorn kernels through acceptance of said kernels passing through said apertures in said bowl bottom when said popped popcorn in sevice bowl is disturbed by shaking said popcorn service bowl.

6. The popcorn service bowl of claim 1 wherein said compartment is further adapted as a support base for said popcorn service bowl said popcorn service bowl is positioned with said opened top end upward.

* * * * *